US005992138A

United States Patent [19]

Brückner et al.

[11] Patent Number: 5,992,138

[45] Date of Patent: Nov. 30, 1999

[54] METHOD FOR OPERATING A GAS AND STEAM-TURBINE PLANT AND PLANT WORKING ACCORDING TO THE METHOD

[75] Inventors: Hermann Brückner, Uttenreuth; Georg Köhler, Forchheim, both of Germany

[73] Assignee: Siemens Aktiengesellschaft, Munich, Germany

[21] Appl. No.: 09/014,158

[22] Filed: Jan. 27, 1998

Related U.S. Application Data

[63] Continuation of application No. PCT/DE96/01244, Jul. 10, 1996.

[30] Foreign Application Priority Data

Jul. 27, 1995 [DE] Germany ..... 195 27 537

[51] Int. Cl.[6] ..... F02G 3/00

[52] U.S. Cl. ..... 60/39.02; 60/39.182; 122/7 B

[58] Field of Search ..... 60/39.182, 39.02; 122/7 R, 7 B, 1 A, 1 R

[56] References Cited

U.S. PATENT DOCUMENTS 3,331,202 7/1967 Brunner ..... 60/39.182
5,269,130 12/1993 Finckh et al. ..... 60/39.182
5,285,627 2/1994 Losel et al. ..... 60/39.182
5,365,730 11/1994 Bruckner et al. ..... 60/39.182

FOREIGN PATENT DOCUMENTS

0436536B1 7/1991 European Pat. Off. .

*Primary Examiner*—Ted Kim
*Attorney, Agent, or Firm*—Herbert L. Lerner; Laurence A. Greenberg

[57] ABSTRACT

A gas and steam-turbine plant includes a waste-heat steam generator downstream of a gas turbine on the exhaust-gas side. The waste-heat steam generator has a high-pressure preheater connected into a water/steam circuit of a steam turbine having a low-pressure part. In order to achieve as high a plant efficiency as possible, a heat exchanger which is disposed outside the waste-heat steam generator has a primary-side inlet connected to an outlet of the high-pressure preheater, a primary-side outlet connected to an inlet of the high-pressure preheater and a secondary side connected into an overflow conduit opening into the low-pressure part of the steam turbine. A method for operating such a plant includes superheating low-pressure steam flowing into the steam turbine by indirect heat exchange with a part stream of preheated feed water extracted from the high-pressure preheater.

10 Claims, 1 Drawing Sheet

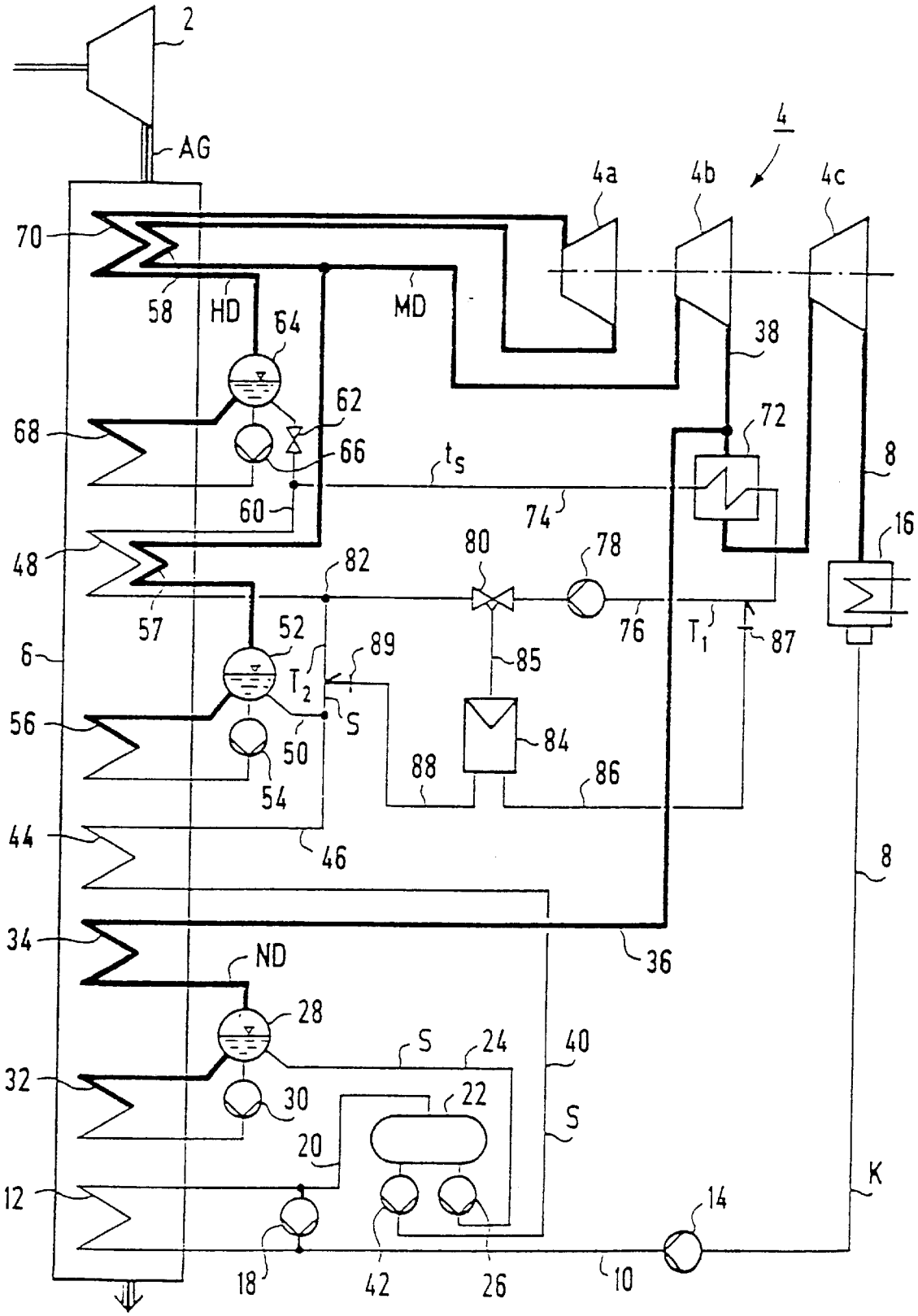
2
AG
4
4a
4b
4c
70
58
HD
MD
64
38
62
72
68
66
$t_s$
8
60
74
16
48
80
78
82
57
76
$T_1$
87
52
89
6
$T_2$
85
56
S
50
84
88
86
54
44
46
8
34
36
ND
28
S
24
40
32
30
22
S
20
K
12
14
18
42
26
10

METHOD FOR OPERATING A GAS AND STEAM-TURBINE PLANT AND PLANT WORKING ACCORDING TO THE METHOD

CROSS-REFERENCE TO RELATED APPLICATION

This application is a continuation of International Application Serial No. PCT/DE96/01244, filed Jul. 10, 1996, which designated the United States.

BACKGROUND OF THE INVENTION

Field of the Invention

The invention relates to a method for operating a gas-turbine and steam-turbine plant including a waste-heat steam generator disposed downstream of a gas turbine on the exhaust-gas side and having a high-pressure preheater connected into a water/steam circuit of a steam turbine with a low-pressure part. The invention also relates to a plant operating according to the method.

In a gas-turbine and steam-turbine plant, heat contained in an expanded working medium from the gas turbine is utilized for generating steam for the steam turbine. The heat is transmitted through the use of a number of heating surfaces which are disposed in the form of tubes or tube bundles in a waste-heat steam generator located downstream of the gas turbine on the exhaust-gas side. The heating surfaces are themselves connected into the water/steam circuit of the steam turbine. The water/steam circuit includes a plurality, for example two or three, pressure stages, with each pressure stage having a preheater, an evaporator and a superheater.

In order to achieve as high a plant efficiency as possible during the transmission of heat, the configuration of the heating surfaces within the waste-heat steam generator is adapted to the temperature trend of the exhaust gas. Thus, in a three-pressure process with intermediate superheating, the so-called three-pressure IS process, an especially high steam-turbine power and consequently an especially high overall efficiency of the plant are achieved for a predetermined gas-turbine power. A gas-turbine and steam-turbine plant working according to the three-pressure IS process is known from European Patent 0 436 536 B1. However, even in that known plant, the overall efficiency is limited to about 55%.

SUMMARY OF THE INVENTION

It is accordingly an object of the invention to provide a method for operating a gas and steam-turbine plant and a plant working according to the method, which overcome the hereinafore-mentioned disadvantages of the heretofore-known methods and devices of this general type and in which an increase in plant efficiency is achieved as a result of a further increase in a utilization of heat content in exhaust gas of the gas turbine.

With the foregoing and other objects in view there is provided, in accordance with the invention, a gas and steam-turbine plant, comprising a gas turbine having an exhaust-gas side; a steam turbine having a low-pressure part and a water/steam circuit; a waste-heat steam generator downstream of the gas turbine on the exhaust-gas side, the waste-heat steam generator having a high-pressure preheater connected into the water/steam circuit, the high-pressure preheater having an inlet and an outlet; an overflow conduit opening into the low-pressure part of the steam turbine; and a heat exchanger disposed outside the waste-heat steam generator and having a primary-side inlet connected to the outlet of the high-pressure preheater, a primary-side outlet connected to the inlet of the high-pressure preheater and a secondary side connected into the overflow conduit.

In accordance with another feature of the invention, a circulating pump and a regulating valve are located downstream of the heat exchanger on the primary side.

In accordance with a further feature of the invention, a controller module is provided for adjusting the quantity of feed water supplied per unit time to the heat exchanger on the primary side.

The controller module serves for approximating the temperature of the feed water returned to the high-pressure preheater through the heat exchanger, to the temperature of the feed water supplied directly to the high-pressure preheater, with the aim of ensuring that the temperatures at a mixing point of the high-pressure preheater are at least approximately equal.

In accordance with an added feature of the invention, for this purpose, a first temperature sensor for recording the temperature of the feed water flowing off from the heat exchanger on the primary side is connected to the controller module, and a second temperature sensor connected to the controller module serves for recording the temperature of the feed water supplied to the high-pressure preheater.

An especially effective adaptation of the heating surface of the high-pressure preheater to the temperature trend of the exhaust gas from the gas turbine within the waste-heat steam generator is achieved by providing the high-pressure preheater with a two-stage construction.

In accordance with an additional feature of the invention, consequently the high-pressure preheater is a second high-pressure preheater which is located downstream of a first high-pressure preheater on the feed-water side and which is disposed upstream of the first high-pressure preheater in the waste-heat steam generator on the exhaust-gas side.

In a water/steam circuit composed of three pressure stages, this principle can be developed by providing, in addition to the intermediate superheater present in a three-pressure IS process, a medium-pressure superheater which is connected to the latter on the feed-water side and which is disposed upstream of the intermediate superheater in the waste-heat steam generator on the exhaust-gas side.

In accordance with yet another feature of the invention, in order to develop this principle, there is provided a low-pressure superheater, which is disposed in the waste-heat steam generator and which is connected to the secondary-side inlet of the heat exchanger on the outlet side.

With the objects of the invention in view, there is also provided a method for operating a gas and steam-turbine plant, which comprises generating steam from heat contained in an expanded working medium supplied by a gas turbine to a waste-heat steam generator; feeding the steam to a steam turbine connected into a water/steam circuit having at least two pressure stages; preheating feed water flowing in the water/steam circuit in a high-pressure preheater disposed in the waste-heat steam generator; and superheating low-pressure steam flowing into the steam turbine by indirect heat exchange with a part stream of preheated feed water extracted from the high-pressure preheater.

In accordance with another mode of the invention, the cooled part stream is admixed again, preferably at the inlet of the high-pressure preheater, with the feed water to be preheated, wherein an approximation of the temperature of the part stream to the feed water to be preheated is carried out by an adjustment of the part stream.

In accordance with a concomitant mode of the invention, in a water/steam circuit composed of three pressure stages, low-pressure steam superheated in the waste-heat steam generator is further superheated, by admixing the low-pressure steam with the low-pressure steam to be superheated by indirect heat exchange.

The advantages achieved through the use of the invention are, in particular, that on one hand, as a result of the superheating of the low-pressure steam by indirect heat exchange outside the waste-heat steam generator with feed water preheated in the high-pressure preheater, heat from the exhaust gas of the gas turbine can be utilized for superheating, and that on the other hand, due to the indirect heat exchange, an additional degree of freedom in comparison with direct heat exchange with the exhaust gas is afforded. By virtue of this additional degree of freedom, the heat transfer can be adapted in an especially favorable way to the particular operationally prevailing state of the low-pressure steam from the steam turbine. An especially favorable utilization of the heat content in the exhaust gas from the gas turbine is thereby possible, even in the case of alternating load states. However, in addition to the increase in efficiency of the gas-turbine and steam-turbine plant which is thus attainable, the invention also makes it possible to increase the generator terminal output of the steam turbine.

Other features which are considered as characteristic for the invention are set forth in the appended claims.

Although the invention is illustrated and described herein as embodied in a method for operating a gas and steam-turbine plant and a plant working according to the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a schematic circuit diagram of an exemplary embodiment of a gas-turbine and steam-turbine plant with a separate heat exchanger for heating low-pressure steam according to the invention.

DESCRIPTION OF THE PREFERRED EMBODIMENTS

Referring now in detail to the single FIGURE of the drawing, there is seen a gas-turbine and steam-turbine plant which includes a gas turbine 2 and a steam turbine 4 as well as a waste-heat steam generator 6, through which hot exhaust gas AG from the gas turbine 2 flows. The steam turbine 4 includes a high-pressure part 4*a*, a medium-pressure part 4*b* as well as a low-pressure part 4*c*. The waste-heat steam generator 6 serves for steam generation and has heating surfaces connected into a water/steam circuit 8 of the steam turbine 4.

For this purpose, the waste-heat steam generator 6 has a condensate preheater 12 which is connected to a condensate conduit 10. The condensate preheater 12 is connected on the inlet side through a condensate pump 14 to a condenser 16 located downstream of the steam turbine 4. The condensate preheater 12 is connected on the outlet side through a circulating pump 18 to an inlet of the condensate preheater 12. Moreover, the condensate preheater 12 is connected on the outlet side through a feed conduit 20 to a feed-water tank 22.

The feed-water tank 22 is connected on the outlet side through a pump 26 and a feed-water conduit 24 and to a low-pressure drum 28. An evaporator 32 is connected through a circulating pump 30 to the low-pressure drum 28. The low-pressure drum 28 is connected on the steam side to a low-pressure superheater 34, which is connected through a steam conduit 36 to an overflow conduit 38 from the medium-pressure part 4*b* to the low-pressure part 4*c* of the steam turbine 4. The low-pressure drum 28, the low-pressure evaporator 32, the low-pressure superheater 34 and the low-pressure part 4*c* together form a low-pressure stage of the water/steam circuit 8.

Moreover, the feed-water tank 22 is connected on the outlet side, through a pump 42 and a feed-water conduit 40 to a first high-pressure preheater 44 which is connected through a connecting conduit 46 to an inlet of a second high-pressure preheater 48. The connecting conduit 46 is connected through a conduit 50 to a medium-pressure drum 52. The medium-pressure drum 52 is in turn connected through a circulating pump 54 to a medium-pressure evaporator 56. The medium-pressure drum 52 is connected on the steam side to a medium-pressure superheater 57 which is connected on the outlet side to an inlet of an intermediate superheater 58.

The intermediate superheater 58 is connected on the inlet side to the high-pressure part 4*a* and on the outlet side to the medium-pressure part 4*b*, of the steam turbine 4. The medium-pressure drum 52, the medium-pressure evaporator 56, the medium-pressure superheater 57, the intermediate superheater 58 and the medium-pressure part 4*b* of the steam turbine 4, together form a medium-pressure stage of the water/steam circuit 8.

The second high-pressure preheater 48 is connected on the outlet side through a connecting conduit 60 and a valve 62 to a high-pressure drum 64. The high-pressure drum 64 is connected through a circulating pump 66 to a high-pressure evaporator 68. The high-pressure drum 64 is connected on the steam side through a high-pressure superheater 70 to the high-pressure part 4*a* of the steam turbine 4. The high-pressure preheaters 44, 48, the high-pressure drum 64, the high-pressure evaporator 68, the high-pressure superheater 70 and the high-pressure part 4*a* of the steam turbine 4, together form a high-pressure stage of the water/steam circuit 8.

A secondary side of a heat exchanger 72 is connected into the overflow conduit 38 between the medium-pressure part 4*b* and the low-pressure part 4*c* of the steam turbine 4. A primary side of the heat exchanger 72 is connected on the inlet side through a conduit 74 to the conduit 60 and is thus connected to the outlet of the second high-pressure preheater 48. A primary-side outlet of the heat exchanger 72 is connected through a conduit 76 to the inlet of the second high-pressure preheater 48. A pump 78 and a regulating valve 80 are connected into the conduit 76. In this case, the conduit 76 opens into the conduit 46 connecting the two high-pressure preheaters 44 and 48, at a mixing point 82.

When the gas-turbine and steam-turbine plant is in operation, condensate K from the condenser 16 is supplied through the pump 14 and the condensate conduit 10 to the condensate preheater 12. In this case, the condensate preheater 12 may be bypassed completely or partially. The condensate K is heated in the condensate preheater 12 and, for this purpose, is circulated at least partially through the circulating pump 18. The heated condensate K is guided through the conduit 20 into the feed-water tank 22. Heating of the feed water takes place in the feed-water tank 22 through the use of bled steam from the steam turbine 4 in a non-illustrated manner. Heated feed water S is supplied, on one hand, to the low-pressure drum 28 and, on the other hand, through the first high-pressure preheater 44 to the medium-pressure drum 52 and through the second high-pressure preheater 48 to the high-pressure drum 64. The feed water S which is supplied to the low-pressure stage is evaporated at low pressure in the low-pressure evaporator 32, with low-pressure steam ND separated in the low-pressure drum 28 being supplied to the low-pressure superheater 34. The low-pressure steam ND that is superheated there is guided into the overflow conduit 38 upstream of the heat exchanger 72.

The feed water S guided into the medium-pressure drum 52 is likewise evaporated in the medium-pressure evaporator 56. The steam which is separated in the medium-pressure drum 52 and which is under medium pressure, is guided through the medium-pressure superheater 57 and is supplied as superheated medium-pressure steam MD to the medium-pressure part 4*b* of the steam turbine 4. In a similar way, the feed water S which is preheated in the second high-pressure preheater or high-pressure economizer 48 is evaporated under high pressure in the high-pressure evaporator 68, with high-pressure steam HD separated in the high-pressure drum 64 being superheated in the high-pressure superheater 70 and being guided in the superheated state into the high-pressure part 4*a* of the steam turbine 4. The steam which is expanded in the high-pressure part 4*a* is superheated once more in the intermediate superheater 58 and is supplied in the superheated state, together with the medium-pressure steam MD superheated in the medium-pressure superheater 56, to the medium-pressure part 4*b* of the steam turbine 4.

The steam which is expanded in the medium-pressure part 4*b* of the steam turbine 4 and which is under low pressure, is guided through the overflow conduit 38 and is superheated in the heat exchanger 72 by indirect heat exchange with a part stream $t_s$ of the feed water S that is preheated in the high-pressure preheater 48 and guided through the conduit 74. At the same time, the low-pressure steam ND which is superheated in the low-pressure superheater 34 is admixed, upstream of the heat exchanger 72, with the steam flowing off from the medium-pressure part 4*b*. The low-pressure steam ND that is superheated in the heat exchanger 72 is expanded in the low-pressure part 4*c* of the steam turbine 4 and is supplied to the condenser 16 for condensation.

The quantity of the part stream $t_s$ of the feed water S that is preheated in the second high-pressure preheater 48 and is supplied per unit time to the heat exchanger 72, is adjusted through the use of the regulating valve 80. In this case, the adjustment is carried out in such a way that a temperature $T_1$ of the part stream $t_s$ and a temperature $T_2$ of the feed water S to be preheated approximate one another, and are preferably equal to one another, at the mixing point 82. For this purpose, a controller module 84 is connected to the regulating valve 80 through a control line 85. Moreover, for this purpose, the controller module 84 is connected through a control line 86 to a first temperature sensor 87 for recording the temperature $T_1$ and through a control line 88 to a second temperature sensor 89 for recording the temperature $T_2$.

A terminal output which is capable of being drawn off at a non-illustrated steam-turbine generator is increased by 1.3% to 2% by connecting the heat exchanger 72 into the overflow conduit 38 for superheating the low-pressure steam ND through the use of the part stream $t_s$ extracted from the high-pressure preheater 48. If the entire low-pressure steam quantity is superheated correspondingly in a two-pressure process, the increase in the steam-turbine power which is thus achieved is more than 2.6%.

We claim:

1. A gas and steam-turbine plant, comprising:

a gas turbine having an exhaust-gas side;

a steam turbine having at least a high-pressure and a low-pressure part which are fluidly connected and a water/steam circuit, said low-pressure part having an inlet side;

a waste-heat steam generator downstream of said gas turbine on said exhaust-gas side, said waste-heat steam generator having a high-pressure preheater connected into said water/steam circuit, said high-pressure preheater having an inlet and an outlet;

an overflow conduit connected downstream of said high-pressure part to said inlet side of said low-pressure part of said steam turbine; and a heat exchanger disposed outside said waste-heat steam generator and having a primary-side inlet connected to said outlet of said high-pressure preheater, a primary-side outlet connected to said inlet of said high-pressure preheater and a secondary side connected to said overflow conduit.

2. The plant according to claim 1, including a circulating pump and a regulating valve downstream of said primary side outlet of said heat exchanger.

3. The plant according to claim 1, including a controller module connected to a regulating valve for adjusting a quantity of feed water supplied per unit time to said heat exchanger on said primary side.

4. The plant according to claim 3, including a first temperature sensor connected to said controller module for recording a temperature of the feed water flowing off from said heat exchanger on said primary side, and a second temperature sensor connected to said controller module for recording a temperature of the feed water supplied to said high-pressure preheater.

5. The plant according to claim 1, wherein said high-pressure preheater is a second high-pressure preheater having a feed-water side and an exhaust-gas side, and a first high-pressure preheater is connected upstream of said second high-pressure preheater on the feed-water side and downstream of said second high-pressure preheater in said waste-heat steam generator on said exhaust-gas side.

6. The plant according to claim 1, wherein said heat exchanger has a secondary-side inlet, and a low-pressure superheater is disposed in said waste-heat steam generator and has an outlet side connected to said secondary-side inlet of said heat exchanger.

7. A method for operating a gas and steam-turbine plant, which comprises:

generating steam from heat contained in an expanded working medium supplied by a gas turbine to a waste-heat steam generator;

feeding the steam to a steam turbine connected into a water/steam circuit having at least high and low pressure stages;

preheating feed water flowing in the water/steam circuit in a high-pressure preheater disposed in the waste-heat steam generator; and superheating low-pressure steam flowing into the low pressure stage of the steam turbine by indirect heat exchange with a cooled part stream of preheated feed water extracted from the high-pressure preheater.

8. The method according to claim 7, which comprises admixing the cooled part stream with the feed water to be preheated, for approximately equalizing a temperature of the part stream and a temperature of the feed water to be preheated, with one another.

9. The method according to claim 8, which comprises adjusting the part stream for carrying out the temperature approximation.

10. The method according to claim 7, which comprises providing three pressure stages in the water/steam circuit, and admixing low-pressure steam superheated in the waste-heat steam generator with the low-pressure steam to be superheated by indirect heat exchange.

* * * * *